US011342669B2

(12) United States Patent
Hsu et al.

(10) Patent No.: US 11,342,669 B2
(45) Date of Patent: May 24, 2022

(54) ANTENNA STRUCTURE AND WIRELESS COMMUNICATION DEVICE USING SAME

(71) Applicant: Chiun Mai Communication Systems, Inc., New Taipei (TW)

(72) Inventors: Cho-Kang Hsu, New Taipei (TW); Min-Hui Ho, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 32 days.

(21) Appl. No.: 17/084,951

(22) Filed: Oct. 30, 2020

(65) Prior Publication Data

US 2021/0135362 A1 May 6, 2021

(30) Foreign Application Priority Data

Oct. 31, 2019 (CN) ..... 201911063223.1
Oct. 31, 2019 (CN) ..... 201911063281.4

(51) Int. Cl.
*H01Q 1/24* (2006.01)
*H01Q 5/371* (2015.01)
*H01Q 21/28* (2006.01)

(52) U.S. Cl.
CPC ..... *H01Q 5/371* (2015.01); *H01Q 1/243* (2013.01); *H01Q 21/28* (2013.01)

(58) Field of Classification Search
CPC ..... H01Q 21/28; H01Q 1/243; H01Q 5/371
See application file for complete search history.

(56) References Cited

U.S. PATENT DOCUMENTS

2014/0347226 A1 11/2014 Iellici et al.
2018/0026337 A1 1/2018 Chen et al.

FOREIGN PATENT DOCUMENTS

CN 103811864 A 5/2014
TW 201806240 A 2/2018

*Primary Examiner* — Graham P Smith
(74) *Attorney, Agent, or Firm* — ScienBiziP, P.C.

(57) ABSTRACT

An antenna structure with wide radiation bandwidth in a reduced physical space includes a housing and a feed portion. The housing defines at least one gap and a slot that divides the housing into two or more radiation portions. The antenna structure further includes a middle-high band reflector (MHR). The MHR is connected to a side frame of the housing and extends along a direction parallel to one radiation portion. The MHR can also be positioned apart from one radiation portion. One end of the MHR is connected to a back board of the housing, the feed portion being electrically connected to one radiation portion. The back board and portions of the side frame without radiation portions are connected to form a system ground plane for grounding the antenna structure.

20 Claims, 14 Drawing Sheets

ANTENNA STRUCTURE AND WIRELESS COMMUNICATION DEVICE USING SAME

FIELD

The subject matter herein generally relates to an antenna structure and a wireless communication device using the antenna structure.

BACKGROUND

Antennas are for receiving and transmitting wireless signals at different frequencies. However, the antenna structure is complicated and occupies a large space in a wireless communication device, which makes miniaturization of the wireless communication device problematic.

Therefore, there is room for improvement within the art.

BRIEF DESCRIPTION OF THE DRAWINGS

Implementations of the present disclosure will now be described, by way of example only, with reference to the attached figures.

DETAILED DESCRIPTION

Figure 1:
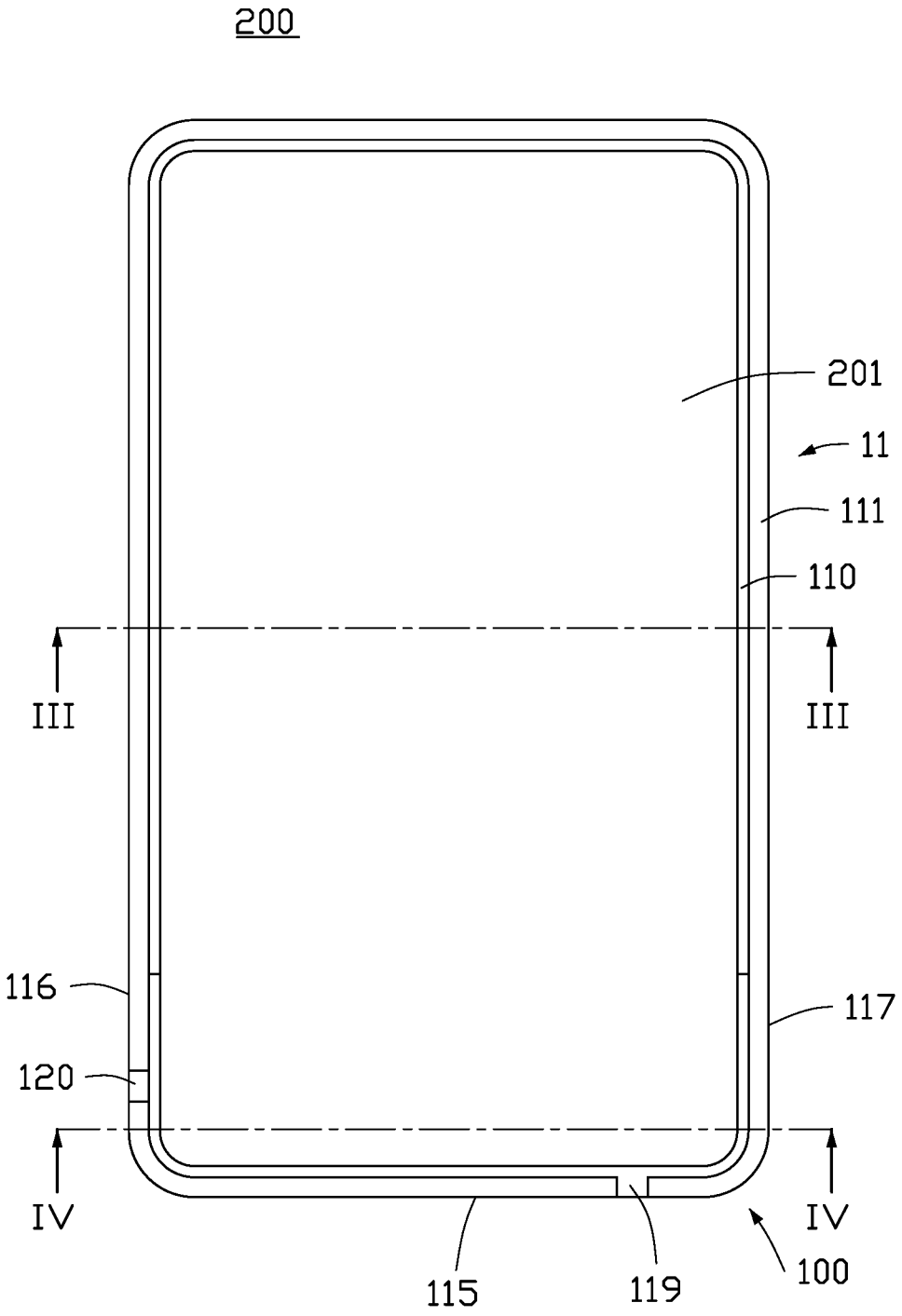
FIG. 1 is a schematic diagram of a first embodiment of a wireless communication device including an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better show details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

The present disclosure is described in relation to an antenna structure and a wireless communication device using same.

Figure 2:
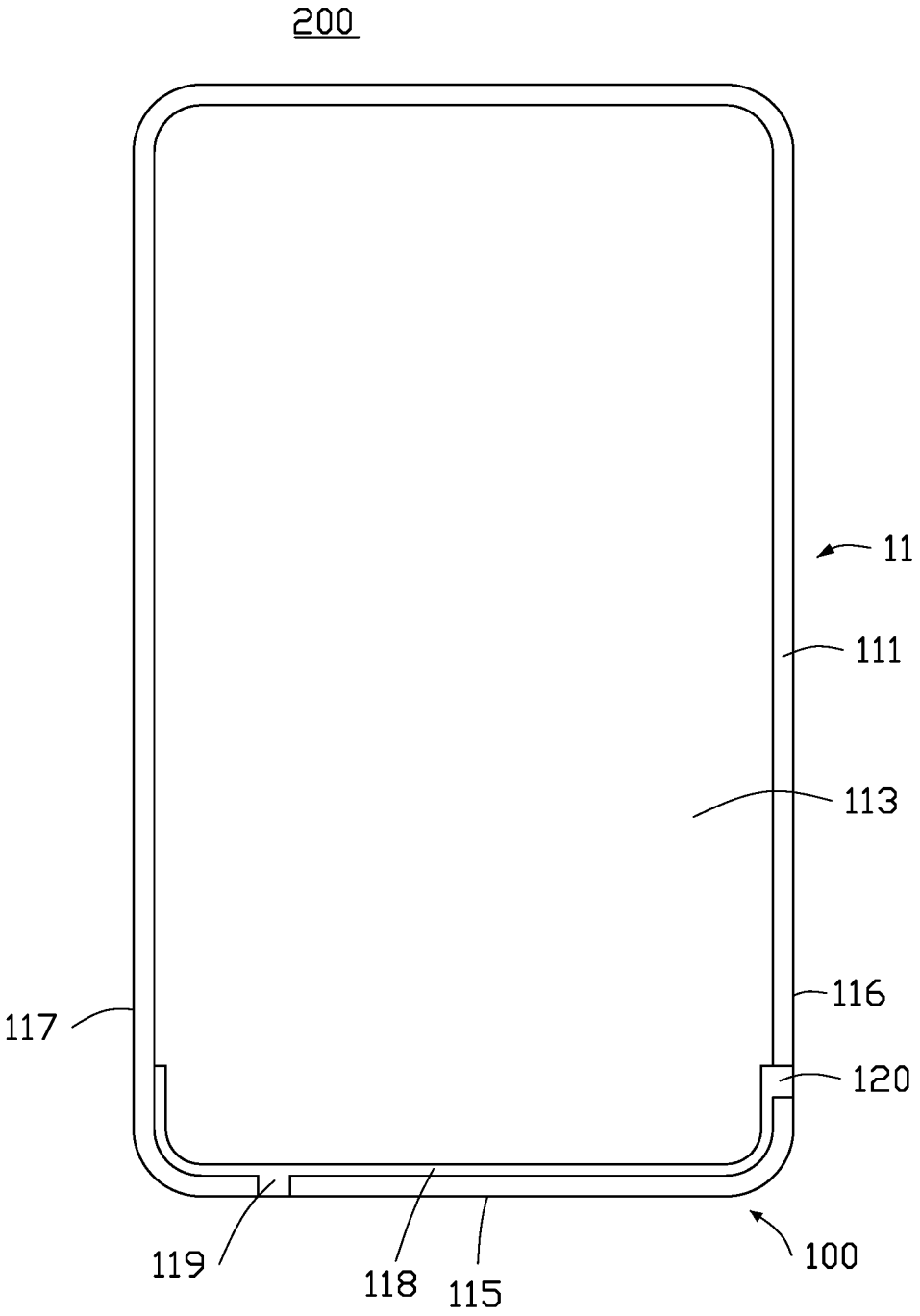
FIG. 2 is similar to FIG. 1, but the wireless communication device being shown from another angle.
Figure 3:
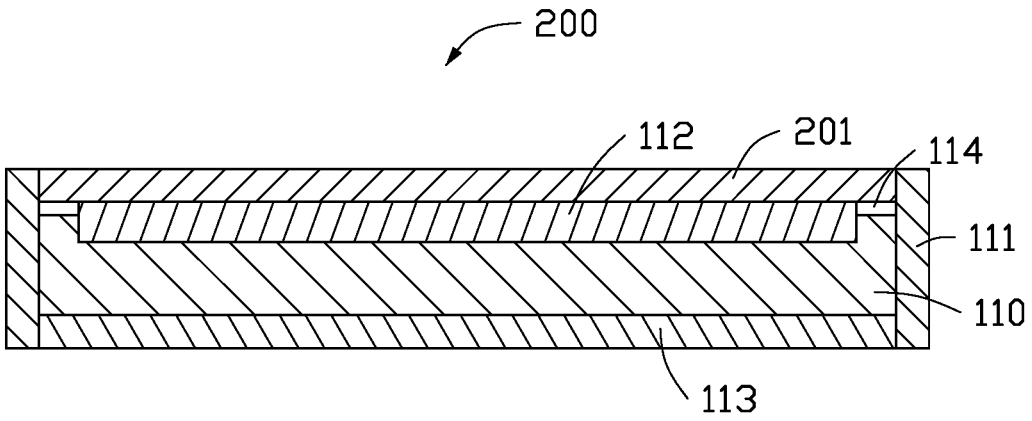
FIG. 3 is a cross-sectional view taken along line of FIG. 1.
Figure 4:
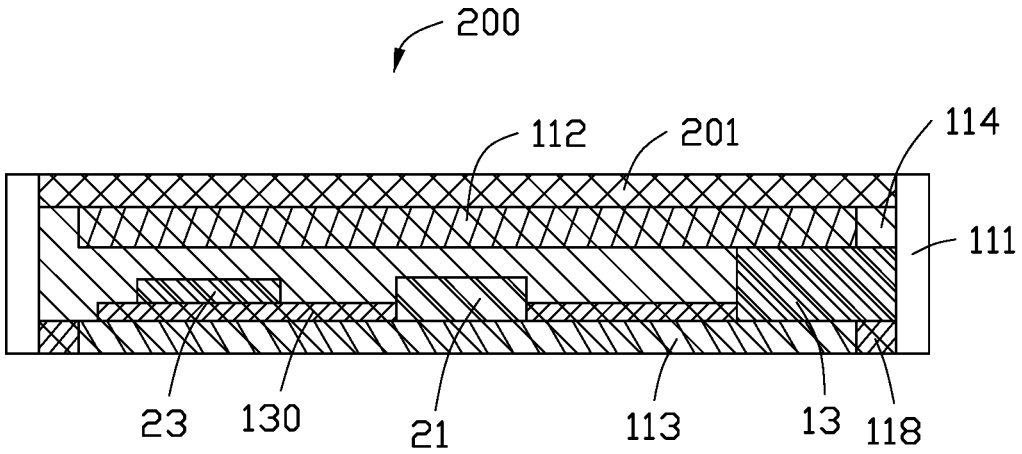
FIG. 4 is a cross-sectional view taken along line IV-IV of FIG. 1.

FIG. 1, FIG. 2, FIG. 3, and FIG. 4 illustrate a first embodiment of a wireless communication device 200 using an antenna structure 100. The wireless communication device 200 can be, for example, a mobile phone or a personal digital assistant. The antenna structure 100 can transmit and receive radio waves, to transmit and exchange wireless signals. FIG. 1 is a schematic diagram of the antenna structure 100 applied to the wireless communication device 200. FIG. 2 is similar to FIG. 1, but shows the wireless communication device 200 from another angle. FIG. 3 is a cross-sectional view taken along line of the wireless communication device 200 of FIG. 1. FIG. 4 is a cross-sectional view taken along line IV-IV of the wireless communication device 200 of FIG. 1.

The antenna structure 100 includes a housing 11, a feed portion 12 (shown in FIG. 5), a middle-high band reflector (MHR) 13, a first switch circuit 14, and a second switch circuit 15. The housing 11 includes at least a system ground plane 110, a side frame 111, a middle frame 112, and a back board 113. The side frame 111, the middle frame 112, and the back board 113 form a space (shown in FIG. 4), and the space receives a circuit board 130. In this embodiment, the circuit board 130 is stacked on the back board 113. The system ground plane 110 may be made of metal or other conductive materials, to provide ground for the antenna structure 100.

The side frame 111 is substantially a ring structure. The side frame 111 is made of metal or other conductive materials. The side frame 111 is positioned at a periphery of the system ground plane 110. That is, the side frame 111 is positioned around the system ground plane 110. In this embodiment, an edge of one side of the side frame 111 is positioned so as to be spaced from the system ground plane 110, a headroom 114 (shown in FIGS. 3 and 4) is formed between the side frame 111 and the system ground plane 110.

In this embodiment, a distance between the side frame 111 and the system ground plane 110 can be adjusted according to requirements. For example, the distance between the side frame 111 and the system ground plane 110 at different locations may be one distance or different distances.

The middle frame 112 is substantially a rectangular sheet. The middle frame 112 is made of metal or other conductive materials. A shape and size of the middle frame 112 are slightly less than those of the system ground plane 110. The middle frame 112 is stacked on the system ground plane 110.

In this embodiment, an opening (not shown) is defined on a side of the side frame 111 near the middle frame 112, for receiving a display unit 201 of the wireless communication device 200. The display unit 201 has a display plane, and the display plane is exposed through the opening.

The back board 113 is made of metal or other conductive materials. The back board 113 is positioned at an edge of the side frame 111. In this embodiment, the back board 113 is positioned at a side of the system ground plane 110 facing away from the middle frame 112, and is in parallel with the display plane of the display unit 201 and the middle frame 112.

In this embodiment, the system ground plane 110, the side frame 111, the middle frame 112, and the back board 113 form a metal frame integrally formed. The middle frame 112 is a metal sheet located between the display unit 201 and the system ground plane 110. The middle frame 112 is used to support the display unit 201, provide electromagnetic shielding, and improve mechanical strength of the wireless communication device 200.

In this embodiment, the side frame 111 includes at least an end portion 115, a first side portion 116, and a second side portion 117. The end portion 115 is a bottom end of the wireless communication device 200. That is, the antenna structure 100 constitutes a lower antenna of the wireless communication device 200. The first side portion 116 and the second side portion 117 are positioned opposite to each other. The first side portion 116 and the second side portion 117 are each disposed at one end of the end portion 115, and are preferably disposed vertically.

The housing 11 defines a slot 118 and at least one gap. The slot 118 is defined on the back board 113. The slot 118 is substantially U-shaped, and defined at a side of the back board 113 near the end portion 115 extending towards the first side portion 116 and the second side portion 117.

In this embodiment, the housing 11 defines two gaps, namely a first gap 119 and a second gap 120. The first gap 119 and the second gap 120 are defined on the side frame 111. The first gap 119 is defined at the end portion 115 and positioned near the second side portion 117. The second gap 120 is spaced from the first gap 119. The second gap 120 is defined at the first side portion 116 near the end portion 115. The first gap 119 and the second gap 120 both penetrate and block the side frame 111, and communicate with the slot 118.

The slot 118 and the at least one gap cooperatively divide at least two radiation portions from the housing 11. In this embodiment, the slot 118, the first gap 119, and the second gap 120 collectively divide two radiation portions from the housing 11, namely a first radiation portion F1 and a second radiation portion F2. In this embodiment, the side frame 111 between the first gap 119 and the second gap 120 forms the first radiation portion F1. The side frame 111 between the first gap 119 and an endpoint of the slot 118 located at the second side portion 117 form the second radiation portion F2.

In this embodiment, the first radiation portion F1 is positioned spaced and insulated from the middle frame 112. A side of the second radiation portion F2 near an end of the slot 118 at the second side portion 117 is connected to the system ground plane 110 and the back board 113. That is, the slot 118 separates the radiators of the frame (that is, the first radiation portion F1 and the second radiation portion F2) and the back board 113. The slot 118 may also separate the frame radiators and the system ground plane 110, and portions other than the slot 118, the side frame 111, the back board 113, and the system ground plane 110 are connected.

In this embodiment, the first gap 119 and the second gap 120 have the same width. A width of the slot 118 is less than or equal to twice the width of the first gap 119 or the second gap 120. The width of the slot 118 is 0.5-2 mm. The width of each of the first gap 119 and the second gap 120 is 1-2 mm.

In this embodiment, the slot 118, the first gap 119, and the second gap 120 are all filled with an insulating material (such as plastic, rubber, glass, wood, ceramic, etc., but not limited to these).

Figure 5:
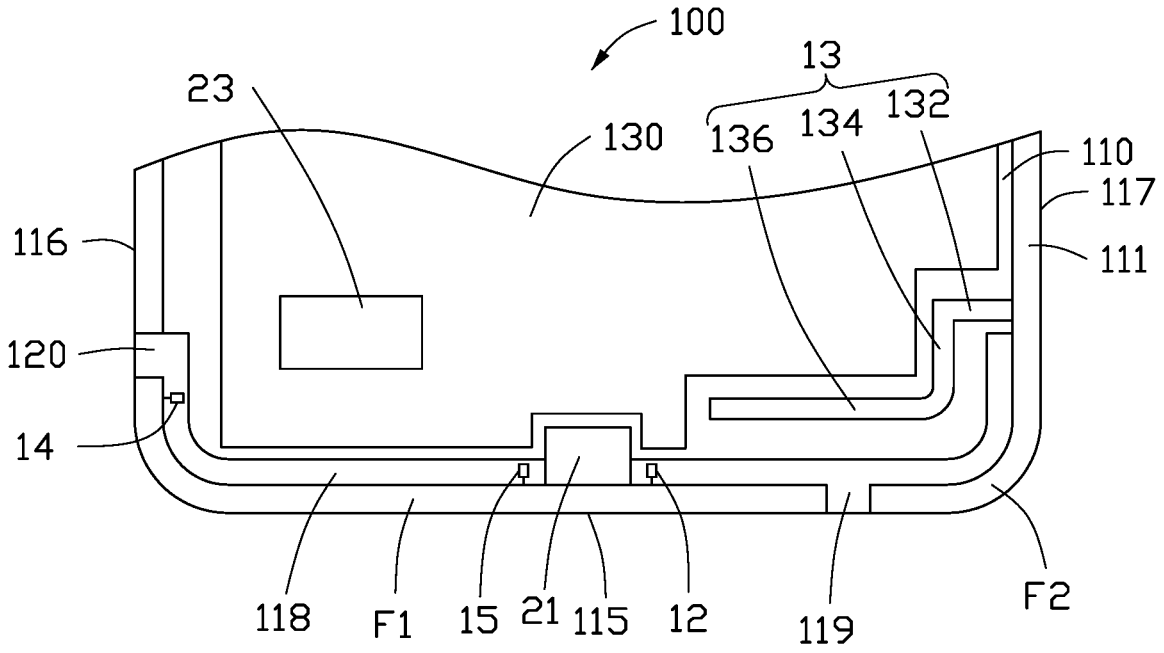
FIG. 5 is an internal schematic diagram of the antenna structure of the wireless communication device of FIG. 1.

Referring to FIG. 5, the wireless communication device 200 further includes at least one electronic component. In this embodiment, the wireless communication device 200 includes at least two electronic components, namely a first electronic component 21 and a second electronic component 23.

The first electronic component 21 is a universal serial bus (USB) interface module. The first electronic component 21 is positioned on an edge of the circuit board 130 adjacent to the first radiation portion F1. The first electronic component 21 is positioned apart from the first radiation portion F1 through the slot 118. The second electronic component 23 is a loudspeaker. The second electronic component 23 is positioned on a side of the circuit board 130 adjacent to the first radiation portion F1. In this embodiment, a distance between the second electronic component 23 and the slot 118 is approximately 2-10 mm. The second electronic component 23 is also positioned apart from the first radiation portion F1 through the slot 118.

In other embodiments, the location of the second electronic component 23 can be adjusted according to specific requirements.

Referring to FIGS. 4 and 5, the system ground plane 110 is generally box-shaped. That is, the system ground plane 110 has a certain thickness. In this embodiment, when the system ground plane 110 is box-shaped, the at least one electronic component (for example, both the first and second electronic components 21, 23) can be fully embedded in the system ground plane 110. Then, the at least one electronic component can be regarded as the system ground plane 110, that is, a large area of metal which is grounded. When the at least one electronic component is put into the system ground plane 110, the system ground plane 110 also reserves corresponding openings and connectors, so that an electrical contact part of the at least one electronic component needing to be connected to external components can be exposed from the system ground plane 110.

In other embodiments, the system ground plane 110 is not limited to being the box-shaped described above, and can also have other shapes.

In this embodiment, the display unit 201 has a high screen-to-body ratio. That is, an area of the display plane of the display unit 201 is greater than 70% of a frontal area of the wireless communication device 200, and even a front full screen can be achieved. In this embodiment, the full screen refers to a slot other than the necessary slot (such as slot 118) defined in the antenna structure 100, the left, the right, and the lower sides of the display unit 201 can be connected to the side frame 111 seamlessly.

In this embodiment, the feed portion 12 is positioned in the headroom 114 between the system ground plane 110 and the side frame 111. One end of the feed portion 12 may be electrically connected to a signal feed point (not shown) on the circuit board 130 by means of an elastic sheet, a microstrip line, a strip line, or a coaxial cable. The other end of the feed portion 12 is electrically connected to a side of the first radiation portion F1 near the first gap 119 through a matching circuit (not shown), to feed current and signals to the first radiation portion F1 and the second radiation portion F2.

In this embodiment, the feed portion 12 may be made of iron, metal copper foil, or a conductor in a laser direct structuring (LDS) process.

The MHR 13 is substantially a metal sheet. A top end of the MHR 13 resists against the middle frame 112, and a bottom end of the MHR 13 resists against the back board 113 (see FIG. 4). One end of the MHR 13 is connected to the second side portion 117 of the side frame 111 and extends in a direction parallel to the second radiation portion F2. The MHR 13 at least has one plane parallel to the second radiation portion F2.

The MHR 13 includes a first section 132, a second section 134, and a third section 136 in that sequence. The first section 132 is substantially a straight section and is connected substantially perpendicularly to the second side portion 117 of the side frame 111. The second section 134 is substantially arc-shaped. The second section 134 is positioned parallel to the second radiation portion F2 at a connecting portion of the second side portion 117 and the end portion 115. The third section 136 is substantially a straight section. The third section 136 is positioned parallel to a part of the second radiation portion F2 located at the end portion 115.

Referring to FIGS. 6A, 6B, 6C, and 6D together, in different embodiments, the third section 136 of the MEM 13 may have different lengths. For example, in the MEM 13 shown in FIG. 6A, the third section 136 extends beyond the first gap 119. In the MHR 13 shown in FIG. 6B, the third section 136 extends to the first gap 119. In the MHR 13 shown in FIG. 6C, the third section 136 does not extend beyond the first gap 119. The antenna structure shown in FIG. 6D does not include the MHR 13.

In this embodiment, a first end of the first switch circuit 14 is electrically connected to a side of the first radiation portion F1 near the second gap 120. A second end of the first switch circuit 14 is electrically connected to the system ground plane 110, namely grounded. The first switch circuit 14 is configured to switch the first radiation portion F1 to the system ground plane 110, so that the first radiation portion F1 is not grounded, or to switch the first radiation portion F1 to a different ground position (equivalent to switching to a component of different impedance), thereby effectively adjusting a bandwidth of the antenna structure 100, to achieve multi-frequency functions.

In this embodiment, a first end of the second switch circuit 15 is electrically connected to a middle portion of the first radiation portion F1. A second end of the second switch circuit 15 is electrically connected to the system ground plane 110, namely grounded. The second switch circuit 15 is spaced from the feed portion 12. In this embodiment, the feed portion 12 and the second switch circuit 15 are spaced from each other at two sides of the first electronic component 21.

The second switch circuit 15 is configured to switch the first radiation portion F1 to the system ground plane 110, so that the first radiation portion F1 is not grounded, or to switch the first radiation portion F1 to a different ground position (equivalent to switching to a different component), thereby effectively adjusting a bandwidth of the antenna structure 100, to achieve multi-frequency functions.

In this embodiment, the specific structures of the first switch circuit 14 and the second switch circuit 15 may take various forms, for example, they may include a single switch, a multiple switch, a single switch with a matching component, or a multiple switch with a matching component. The first switch circuit 14 and the second switch circuit 15 can adopt the same structure. In this embodiment, the first switch circuit 14 is taken as an example for description as follows.

Figure 7A:
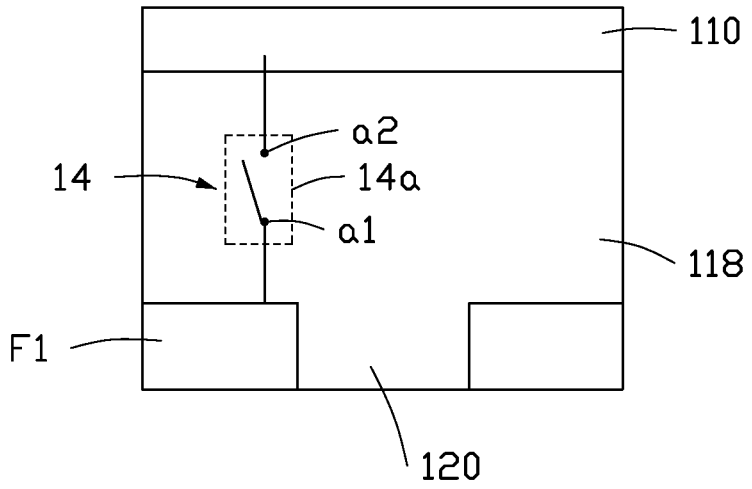
FIGS. 7A, 7B, 7C, and 7D are circuit diagrams of a switch circuit of the antenna structure of FIG. 5.

Referring to FIG. 7A, the first switch circuit 14 includes a single switch 14*a*. The single switch 14*a* includes a movable contact a1 and a static contact a2. The movable contact a1 is electrically connected to the first radiation portion F1. The static contact a2 of the single switch 14*a* is electrically connected to the system ground plane 110. Therefore, by controlling the single switch 14*a* to be turned on or off, the first radiation portion F1 is electrically connected or disconnected from the system ground plane 110, and the first radiation portion F1 is controlled to be grounded or not grounded, to achieve the functions of multi-frequency.

Figure 7B:
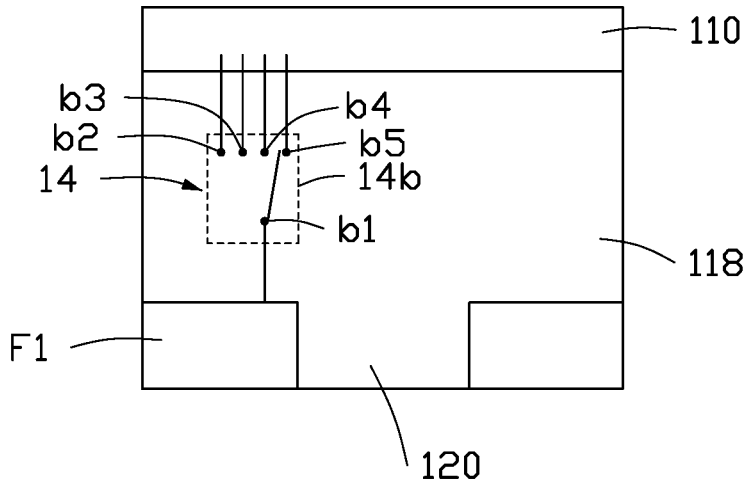

Referring to FIG. 7B, the first switch circuit 14 includes a multiplexing switch 14*b*. In the embodiment, the multiplexing switch 14*b* is a four-way switch. The multiplexing switch 14*b* includes a movable contact b1, a first static contact b2, a second static contact b3, a third static contact b4, and a fourth static contact b5. The movable contact b1 is electrically connected to the first radiation portion F1. The first static contact b2, the second static contact b3, the third static contact b4, and the fourth static contact b5 are each electrically connected to different positions of the system ground plane 110.

By controlling the switching of the movable contact b1, the movable contact b1 can be switched to the first static contact b2, the second static contact b3, the third static contact b4, or the fourth static contact b5. Therefore, the first radiation portion F1 may be electrically connected to different positions of the system ground plane 110, thereby achieving the functions of multi-frequency.

Figure 7C:
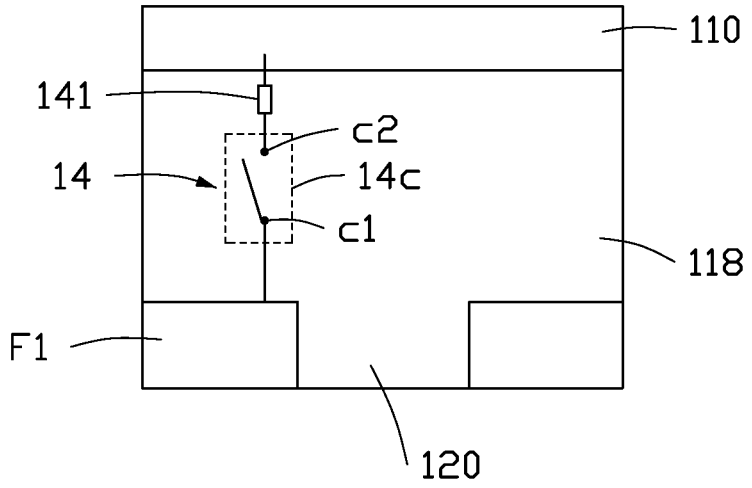

Referring to FIG. 7C, the first switch circuit 14 includes a single switch 14*c* and an impedance-matching component 141. The single switch 14*c* includes a movable contact c1 and a static contact c2. The movable contact c1 is electrically connected to the first radiation portion F1. The static contact c2 is electrically connected to the system ground plane 110 through the impedance-matching component 141. The impedance-matching component 141 has a preset impedance. The impedance-matching component 141 may include an inductor, a capacitor, or a combination of an inductor and a capacitor.

Figure 7D:
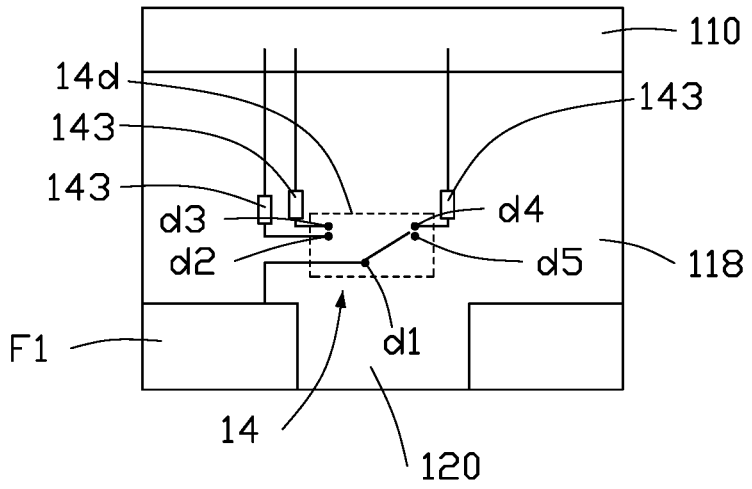

Referring to FIG. 7D, the first switch circuit 14 includes a multiplexing switch 14*d* and at least one impedance-matching component 143. In this embodiment, the multiplexing switch 14*d* is a four-way switch, and the first switch circuit 14 includes three impedance-matching components 143. The multiplexing switch 14*d* includes a movable contact d1, a first static contact d2, a second static contact d3, a third static contact d4, and a fourth static contact d5. The movable contact d1 is electrically connected to the first radiation portion F1. The first static contact d2, the second static contact d3, and the third static contact d4 are electrically connected to the system ground plane 110 through corresponding impedance-matching components 143. The fourth static contact d5 is suspended. Each of the three impedance-matching components 143 has a preset impedance, and the preset impedances of the three impedance-matching components 143 may be the same or different. Each of the three impedance-matching components 143 may include an inductor, a capacitor, or a combination of an inductor and a capacitor. The location where each of the three impedance-matching components 143 is electrically connected to the system ground plane 110 may be the same or different.

By controlling the switching of the movable contact d1, the movable contact d1 can be switched to the first static contact d2, the second static contact d3, the third static contact d4, or the fourth static contact d5. Therefore, the first radiation portion F1 may be electrically connected to the system ground plane 110 or disconnected from the system ground plane 110 through different impedance-matching components 143, thereby achieving the functions of multi-frequency.

In other embodiments, the first switch circuit 14 is not limited to being electrically connected to the first radiation portion F1, and its location can be adjusted according to specific requirements. For example, the first switch circuit 14 may be electrically connected to the second radiation portion F2.

Figure 8:
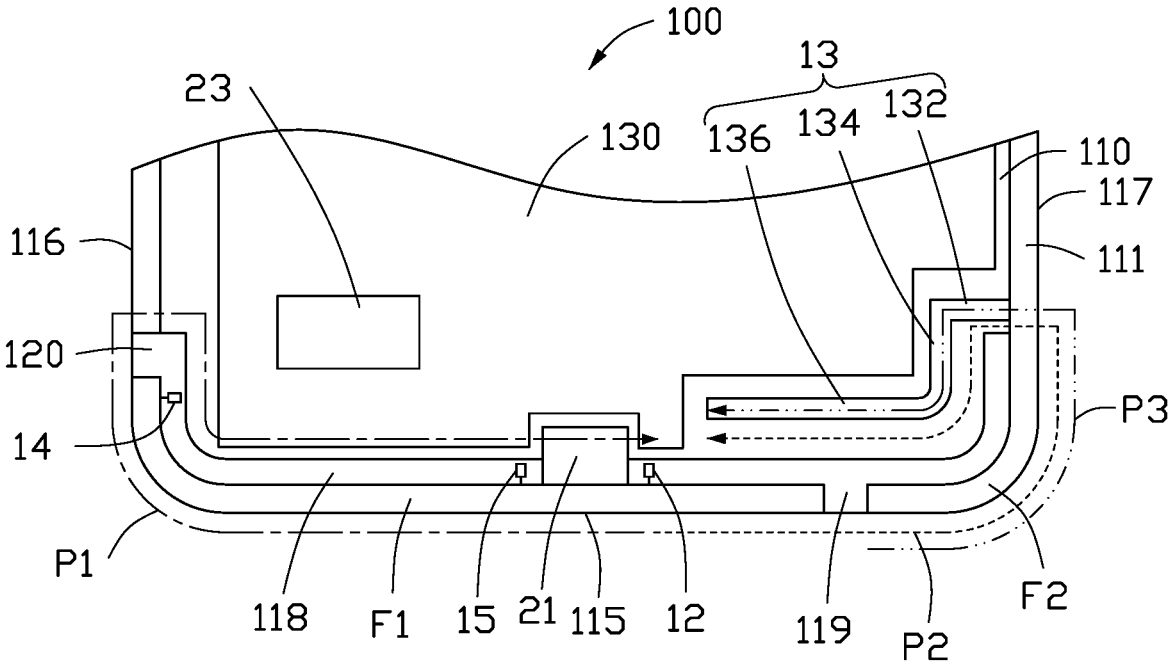
FIG. 8 is a current path distribution graph of the antenna structure of FIG. 5.

FIG. 8 illustrates a diagram of current paths of the antenna structure 100. When the feed portion 12 supplies a current, the current flows through the first radiation portion F1, and toward to the second gap 120 (path P1). Therefore, the first radiation portion F1 forms a monopole antenna, to excite a first working mode and generate a radiation signal in a first radiation frequency band.

When the feed portion 12 supplies a current, the current will flow through the first radiation portion F1 and the second radiation portion F2. The current further flows through the MHR 13 along the side frame 111. The current flows through the MEM 13 and finally flows to the system ground plane 110 and the middle frame 112, namely ground (path P2). Therefore, the second radiation portion F2 forms a loop antenna to excite a second working mode and generate a radiation signal in a second radiation frequency band.

When the feed portion 12 supplies a current, the current flows through the second radiation portion F2. The current further flows through the MHR 13 along the side frame 111. The current flows through the MHR 13 and finally flows to the system ground plane 110 and the middle frame 112, namely ground (path P3), and a third working mode is excited to generate a radiation signal in a third radiation frequency band.

In this embodiment, the first working mode is a Long Term Evolution Advanced (LTE-A) low frequency mode. The second working mode is an LTE-A middle frequency mode. The third working mode is an LTE-A high-frequency mode. The frequency of the first radiation frequency band is 700-960 MHz. The frequency of the second radiation frequency band is 1710-2170 MHz. The frequency of the third radiation frequency band is 2300-2690 MHz.

In this embodiment, the side frame 111 and the system ground plane 110 are also electrically connected through connection methods such as spring, solder, and probe. The location of an electrical connection point between the side frame 111 and the system ground plane 110 can be adjusted according to the frequency required. For example, if the electrical connection point between the side frame 111 and the system ground plane 110 is close to the feed portion 12, the frequency of the low frequency of the antenna structure 100 is shifted toward a higher frequency. When the electrical connection point between the side frame 111 and the system ground plane 110 is kept away from the feed portion 12, the frequency of the low frequency of the antenna structure 100 is shifted to a lower frequency.

Figure 6A:
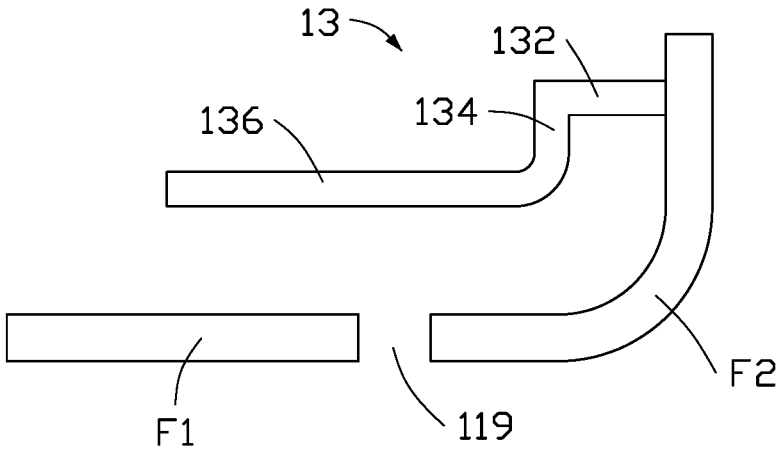
FIGS. 6A, 6B, 6C, and 6D are isometric views of a middle-high band reflector of the antenna structure of FIG. 1.
Figure 6B:
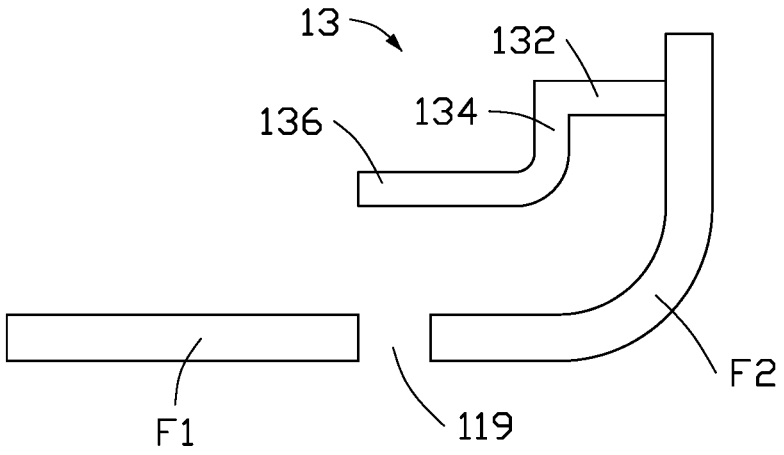
Figure 6C:
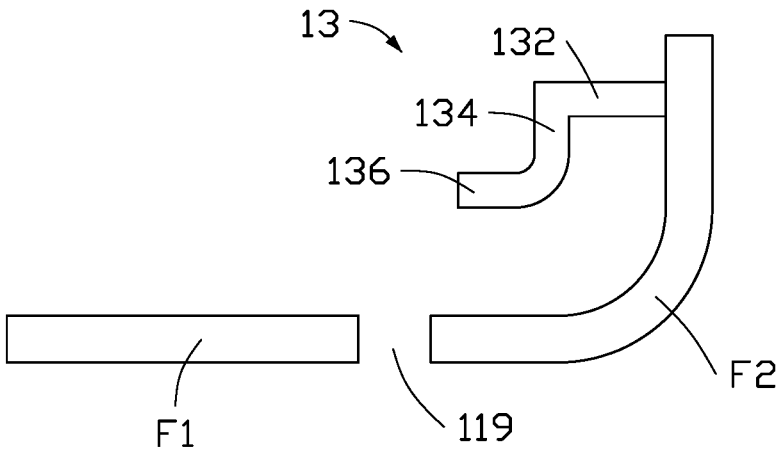
Figure 6D:
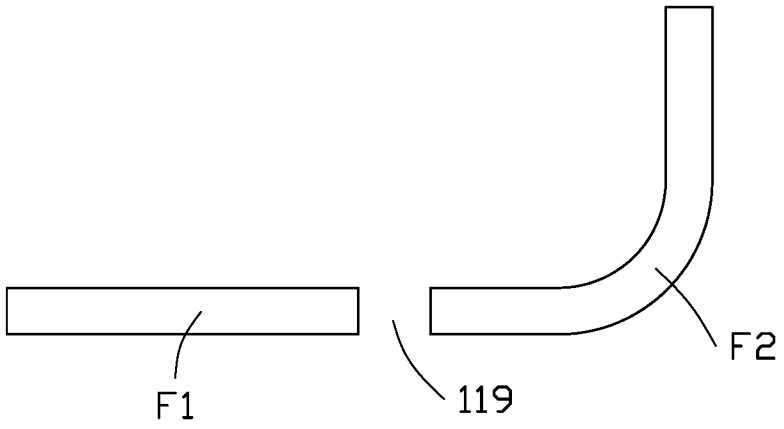
Figure 9:
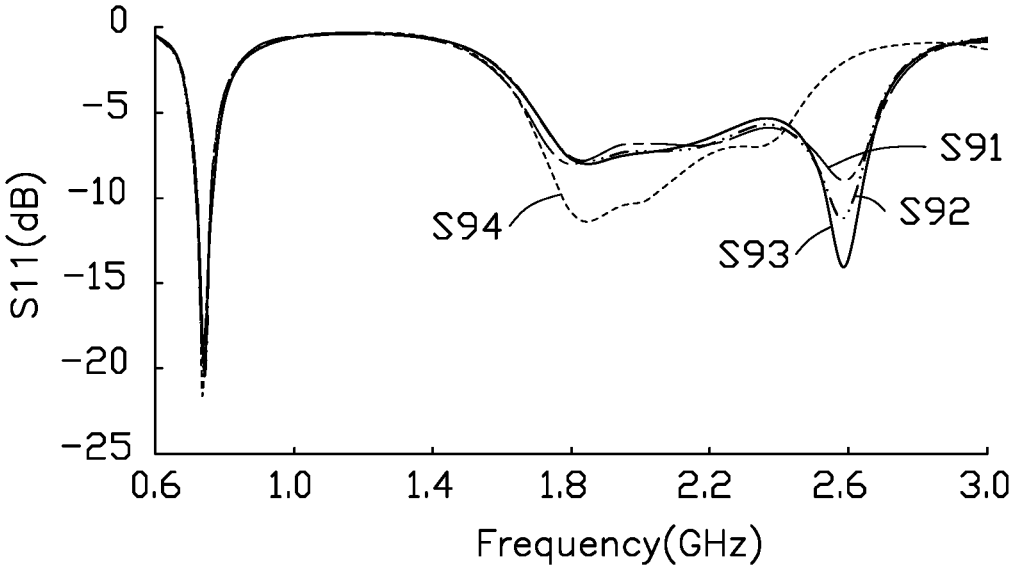
FIG. 9 is a scattering parameter graph of the antenna structure of FIG. 1.

FIG. 9 is a graph of scattering parameters (S parameters) of the antenna structure 100 with the MHR 13 shown in FIGS. 6A to 6D. A curve S91 is an S11 value when the antenna structure 100 works with the MHR 13 shown in FIG. 6A. A curve S92 is an S11 value when the antenna structure 100 works with the MHR 13 shown in FIG. 6B. A curve S93 is an S11 value when the antenna structure 100 works with the MHR 13 shown in FIG. 6C. A curve S94 is an S11 value when the antenna structure 100 does not include the MHR 13, as shown in FIG. 6D.

Figure 10:
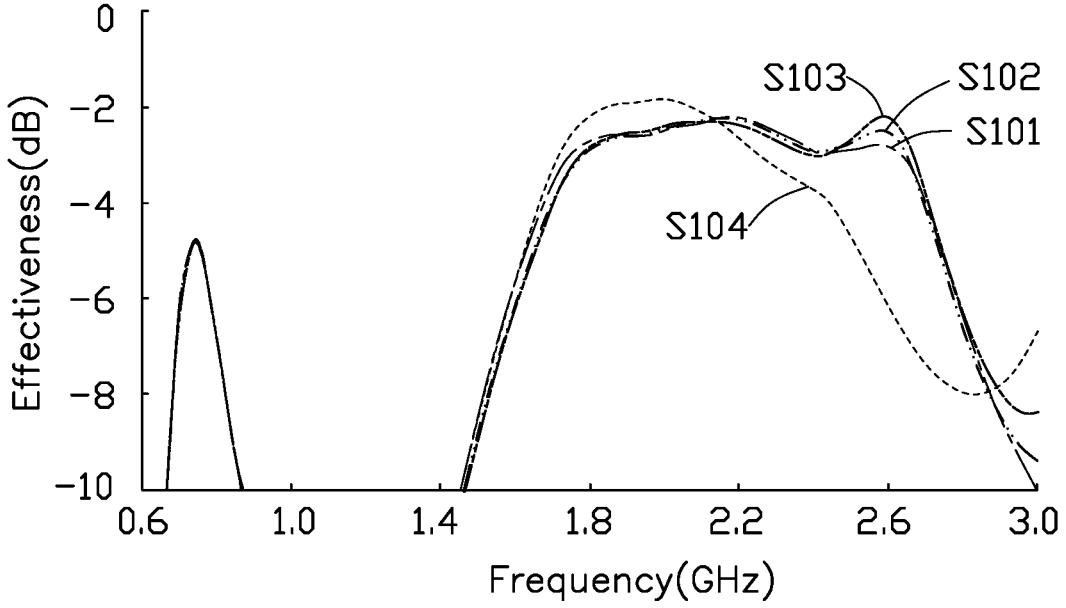
FIG. 10 is a total radiation efficiency graph of the antenna structure of FIG. 1.

FIG. 10 is a graph of total radiation efficiency of the antenna structure 100 with the MHR 13 shown in FIGS. 6A to 6D. A curve S101 is a total radiation efficiency when the antenna structure 100 works with the MHR 13 shown in FIG. 6A. A curve S102 is a total radiation efficiency when the antenna structure 100 works with the MHR 13 shown in FIG. 6B. A curve S103 is a total radiation efficiency when the antenna structure 100 works with the MHR 13 shown in FIG. 6C. A curve S104 is a total radiation efficiency when the antenna structure 100 does not include the MEM 13, as shown in FIG. 6D.

FIG. 9 and FIG. 10 show the antenna structure 100 provided with the MHR 13 and the first and second switch circuits 14, 15, to switch between various low frequency modes of the antenna structure 100. This effectively improves the low frequency bandwidth and gives optimal antenna effectiveness. Furthermore, when the antenna structure 100 works in the LTE-A low frequency band (700-960 MHz), the LTE-A medium frequency (1710-2170 MHz), and high frequency bands (2300-2690 MHz), communication bands commonly used in the world are covered. Specifically, the antenna structure 100 can cover GSM850/900/WCDMA Band5/Band8/Band13/Band17/Band20 at low frequencies, GSM 1800/1900/WCDMA 2100 (1710-2170 MHz) at medium frequencies, and LTE-A Band1, Band40, Band41 (2300-2690 MHz) at high frequencies. The designed frequency bands of the antenna structure 100 can be applied to the operation of GSM Qual-band, UMTS Band I/II/V/VIII frequency bands, and LTE 850/900/1800/1900/2100/2300/2500 frequency bands, as commonly used worldwide.

Figure 11:
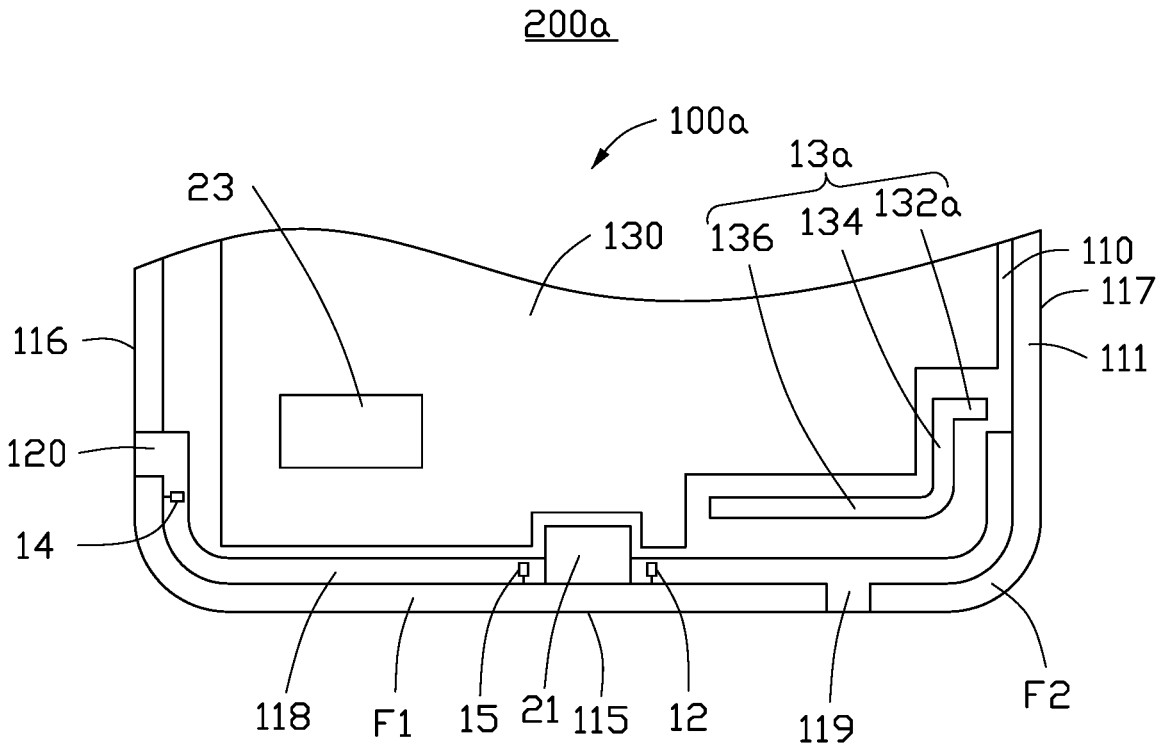
FIG. 11 is a schematic diagram of a second embodiment of a wireless communication device with an antenna structure.
Figure 12:
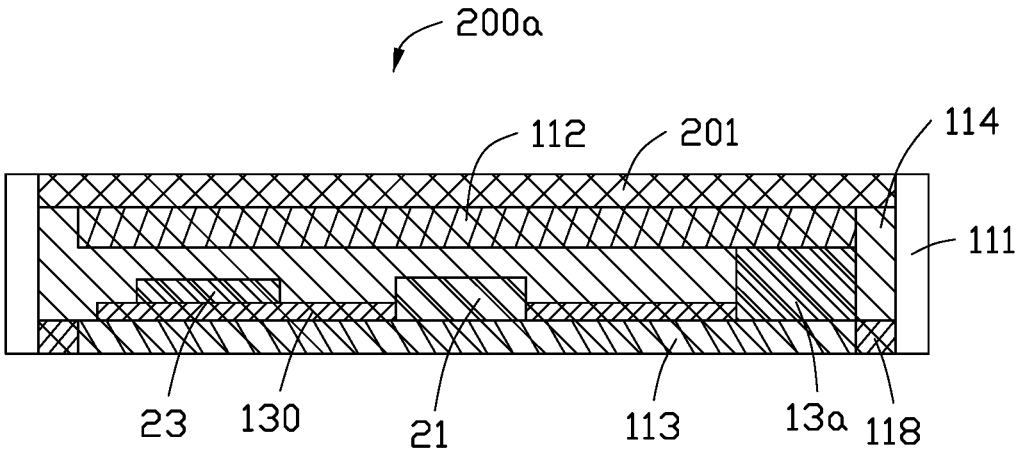
FIG. 12 is a cross-sectional view of the wireless communication device of FIG. 11.

FIG. 11 and FIG. 12 illustrate an antenna structure 100*a* in accordance with a second embodiment of the present disclosure. The antenna structure 100*a* can be applied to a wireless communication device 200*a*. The antenna structure 100*a* is used to transmit and receive radio waves, to transmit and exchange wireless signals.

The antenna structure 100*a* includes a housing 11, a feed portion 12, a MEM 13*a*, a first switch circuit 14, and a second switch circuit 15. The housing 11 includes at least a side frame 111, a middle frame 112, and a back board 113. The side frame 111, the middle frame 112, and the back board 113 form a space, and the space receives a circuit board 130. In this embodiment, the circuit board 130 is stacked on the back board 113.

The side frame 111 includes an end portion 115, a first side portion 116, and a second side portion 117. In this embodiment, the housing 11 defines a slot 118, a first gap 119, and a second gap 120.

In this embodiment, the antenna structure 100*a* is different from the antenna structure 100 in that a location relationship between the MHR 13*a* and the side frame 111 is different from the location relationship between the MHR 13 and the side frame 111 in the first embodiment.

Specifically, in this second embodiment, a top end of the MHR 13*a* resists against the middle frame 112, and a bottom end of the MHR 13*a* resists against the back board 113 (see FIG. 12). The MHR 13*a* is spaced from the second radiation portion F2 and the first gap 119.

One end of the MHR 13 is connected to the second side portion 117 of the frame 111 and extends in a direction parallel to the second radiation portion F2. The MHR 13 at least has one plane parallel to the second radiation portion F2. The MHR 13*a* has at least one plane parallel to the second radiation portion F2.

The MHR 13*a* includes a first section 132*a*, a second section 134, and a third section 136 in that sequence. The first section 132*a* is roughly a straight section. A length of the first section 132*a* is slightly less than a length of the first section 132. The first section 132*a* is perpendicular to the second side portion 117 of the side frame 111. The second section 134 is substantially arc-shaped. The second section 134 is positioned parallel to the second radiation portion F2 at the connecting portion of the second side portion 117 and the end portion 115. The third section 136 is substantially a straight section. The third section 136 is positioned parallel to a part of the second radiation portion F2 located at the end portion 115.

Figure 13:
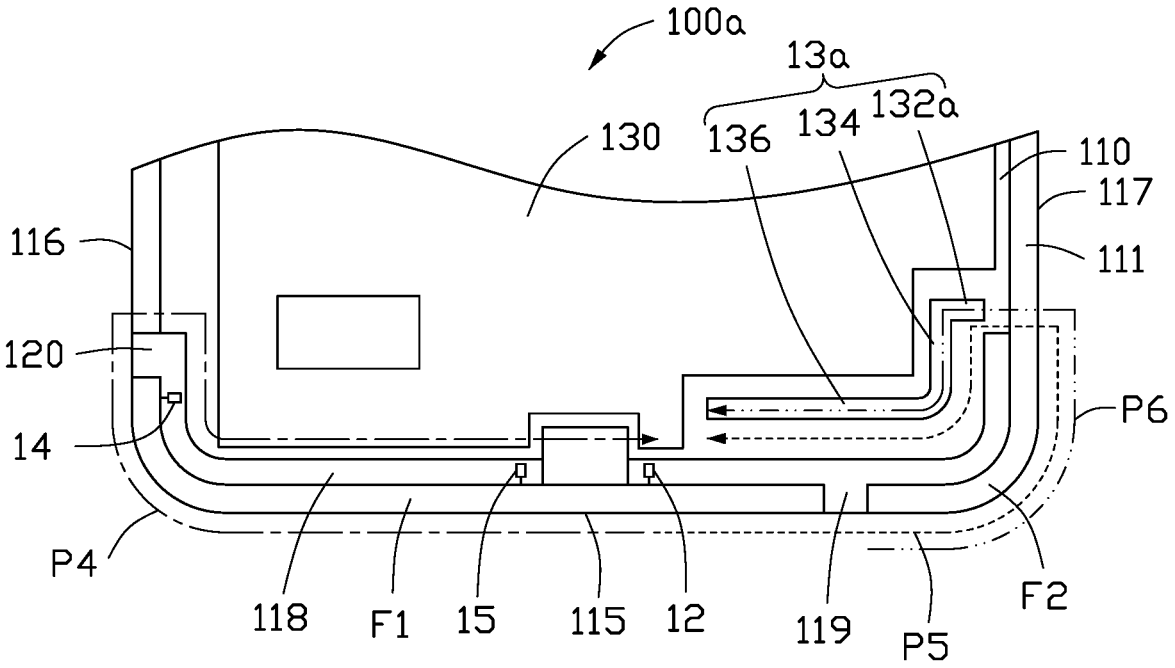
FIG. 13 is a current path distribution graph of the antenna structure of the wireless communication device of FIG. 11.

FIG. 13 illustrates a diagram of current paths of the antenna structure 100*a*. When the feed portion 12 supplies a current, the current flows through the first radiation portion F1 toward to the second gap 120 (path P4). Therefore, the first radiation portion F1 forms a monopole antenna, to excite the first working mode and generate a radiation signal in the first radiation frequency band.

When the feed portion 12 supplies a current, the current will flow through the first radiation portion F1 and the second radiation portion F2. The current is coupled to the MHR 13*a* through the second radiation portion F2. The current flows through the MHR 13*a* and finally flows to the system ground plane 110 and the middle frame 112, namely ground (path P5). Therefore, the second radiation portion F2 forms a loop antenna to excite the second working mode and generate a radiation signal in the second radiation frequency band.

When the feed portion 12 supplies a current, the current flows through the second radiation portion F2. The current is coupled to the MHR 13*a* through the second radiation portion F2. The current flows through the MHR 13*a* and finally flows to the system ground plane 110 and the middle frame 112, namely ground (path P6), and the third working mode is excited to generate a radiation signal in the third radiation frequency band.

The antenna structures 100, 100*a* each set at least one gap (such as the first gap 119 and the second gap 120) on the side frame 111 to create at least two radiation portions from the side frame 111. The antenna structures 100, 100*a* are further provided with the MHRs 13, 13*a* to provide spacing from the radiation portion (for example, the second radiation portion F2). The antenna structures 100, 100*a* further include the first switch circuit 14 and the second switch circuit 15 at the ends of different radiation portions (such as the first radiation portion F1 and the second radiation portion F2). Therefore, it can cover multiple frequency bands such as low frequency, middle frequency, and high frequency through different switching methods, which meets the carrier aggregation application (CA) of LTE-A, and renders the radiation of the antenna structures 100, 100*a* more effective in broadband ranges compared to a general metal back. In addition, the antenna structures 100, 100*a* each has a front full screen, and the antenna structures 100, 100*a* still have good performance in the less-than-optimal environment of the back board 113, the side frame 111, and a large area of grounded metal around it.

Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure comprising:

a housing, the housing comprising a side frame and a back board, the side frame and the back board both made of metallic material, the side frame positioned at a periphery of the back board, wherein the side frame defines at least one gap, the back board defines a slot, the slot and the at least one gap divide at least two radiation portions from the side frame;

a middle-high band reflector (MHR), wherein the MHR is connected to the side frame and extends along a direction parallel to one of the at least two radiation portions, the MEM is spaced from one of the at least two radiation portions, one end of the MHR is connected to the back board; and a feed portion, wherein the feed portion is electrically connected to one of the at least two radiation portions;

wherein the back board and the side frame other than the at least two radiation portions are connected to each other to form a system ground plane to provide a ground for the antenna structure.

2. The antenna structure of claim 1, further comprising a first switch circuit and a second switch, wherein one end of the first switch circuit and one end of the second switch circuit are both electrically connected to one of the at least two radiation portions, another end of the first switch circuit and another end of the second switch circuit are both electrically connected to the system ground plane.

3. The antenna structure of claim 2, wherein the first switch circuit and the second switch circuit have the same structure, each of the first switch circuit and the second switch circuit comprises a single switch, the single switch comprises a movable contact and a static contact, the movable contact of the single switch is electrically connected to one of the at least two radiation portions, the static contact of the single switch is directly electrically connected to the system ground plane or electrically connected to the system ground plane through an impedance-matching component, and the impedance-matching component has a preset impedance.

4. The antenna structure of claim 2, wherein the first switch circuit and the second switch circuit have the same structure, each of the first switch circuit and the second switch circuit comprises a multiplexing switch, the multiplexing switch comprises a movable contact, a first static contact, a second static contact, a third static contact, and a fourth static contact, the movable contact is electrically connected to the one of the at least two radiation portions, the first static contact, the second static contact, and the third static contact are directly electrically connected to different positions of the system ground plane or electrically connected to the different positions of the system ground plane through an impedance-matching component, the fourth static contact is directly electrically connected to the system ground plane or suspended, and the impedance-matching component has a preset impedance.

5. The antenna structure of claim 1, further comprising a middle frame, wherein the middle frame is made of metallic material and is parallel to the back board, the system ground plane further comprises the middle frame, the MHR is a metal sheet, the other end of the MHR is connected to the middle frame.

6. The antenna structure of claim 2, wherein the side frame comprises an end portion, a first side portion, and a second side portion, the first side portion and the second side portion are respectively connected to both ends of the end portion, the slot is defined on a side of the back board near the end portion and extends in a direction of the first side portion and the second side portion;

wherein the side frame defines two gaps, the two gaps comprises a first gap and a second gap, the first gap and the second gap are spaced apart on the side frame;

wherein the side frame between the first gap and the second gap forms a first radiation portion, the side frame between the first gap and the slot located at an end of the second side portion forms a second radiation portion;

wherein the feed portion is electrically connected to the first radiation portion to feed a current to the first radiation portion and the second radiation portion; and wherein the first switch circuit is electrically connected to an end of the first radiation portion adjacent to the second gap, the second switch circuit is electrically connected to a middle location of the first radiation portion and is spaced from the feed portion.

7. The antenna structure of claim 6, wherein one end of the MHR is connected to the second side portion of the side frame, extends along a direction parallel to the second radiation portion, the MHR at least has a plane parallel to the second radiation portion; or the MHR is spaced apart from the second radiation portion and the first gap;

wherein the MHR comprises a first section, a second section, and a third section, the first section is substantially a straight section, the first section is perpendicularly connected to or perpendicularly spaced from the second side portion of the side frame;

wherein the second section is substantially arc-shaped, the second section is positioned parallel to the second radiation portion at a connecting portion of the second side portion and the end portion; and wherein the third section is substantially a straight section, the third section is positioned parallel to a part of the second radiation portion located at the end portion.

8. The antenna structure of claim 7, wherein the third section of the MHR extends beyond the first gap; or the third section of the MHR extends to the first gap; or the third section of the MHR does not extend beyond the first gap.

9. The antenna structure of claim 7, wherein when the feed portion supplies a current, the current flows through the first radiation portion, and toward to the second gap to excite a first working mode and generate a radiation signal in a first radiation frequency band;

wherein when the feed portion supplies a current, the current flows through the first radiation portion and the second radiation portion, the current further flows through the MHR along the side frame or the current is coupled to the MHR through the second radiation portion, the current flows through the MHR and finally flows to the system ground plane to excite a second working mode and generate a radiation signal in a second radiation frequency band;

wherein when the feed portion supplies a current, the current flows through the second radiation portion, the current further flows through the MHR along the side frame or the current is coupled to the MHR through the second radiation portion, the current flows through the MHR and finally flows to the system ground plane to excite a third working mode and generate a radiation signal in a third radiation frequency band; and wherein a frequency of a first radiation frequency band is less than a frequency of a second radiation frequency band, and a frequency of the second radiation frequency band is less than a frequency of the third radiation frequency band.

10. The antenna structure of claim 9, wherein the first working mode is a Long Term Evolution Advanced (LTE-A) low frequency mode, the second working mode is an LTE-A middle frequency mode, and the third working mode is an LTE-A high-frequency mode;

wherein the frequency of the first radiation frequency band is 700-960 MHz, the frequency of the second radiation frequency band is 1710-2170 MHz, and the frequency of the third radiation frequency band is 2300-2690 MHz.

11. A wireless communication device, comprising:

an antenna structure comprising:

a housing, the housing comprising a side frame and a back board, the side frame and the back board both made of metallic material, the side frame positioned at a periphery of the back board, wherein the side frame defines at least one gap, the back board defines a slot, the slot and the at least one gap divide at least two radiation portions from the side frame;

a middle-high band reflector (MHR), wherein the MHR is connected to the side frame and extends along a direction parallel to one of the at least two radiation portions, or the MHR is spaced from one of the at least two radiation portions, one end of the MEM is connected to the back board; and a feed portion, wherein the feed portion is electrically connected to one of the at least two radiation portions;

wherein the back board and the side frame other than the at least two radiation portions are connected to each other to form a system ground plane to provide a ground for the antenna structure.

12. The wireless communication device of claim 11, wherein the antenna structure further comprises a first switch circuit and a second switch, one end of the first switch circuit and one end of the second switch circuit are both electrically connected to one of the at least two radiation portions, another end of the first switch circuit and another end of the second switch circuit are both electrically connected to the system ground plane.

13. The wireless communication device of claim 12, wherein the first switch circuit and the second switch circuit have the same structure, each of the first switch circuit and the second switch circuit comprises a single switch, the single switch comprises a movable contact and a static contact, the movable contact of the single switch is electrically connected to one of the at least two radiation portions, the static contact of the single switch is directly electrically connected to the system ground plane or electrically connected to the system ground plane through an impedance-matching component, and the impedance-matching component has a preset impedance.

14. The wireless communication device of claim 12, wherein the first switch circuit and the second switch circuit have the same structure, each of the first switch circuit and the second switch circuit comprises a multiplexing switch, the multiplexing switch comprises a movable contact, a first static contact, a second static contact, a third static contact, and a fourth static contact, the movable contact is electrically connected to the one of the at least two radiation portions, the first static contact, the second static contact, and the third static contact are directly electrically connected to different positions of the system ground plane or electrically connected to the different positions of the system ground plane through an impedance-matching component, the fourth static contact is directly electrically connected to the system ground plane or suspended, and the impedance-matching component has a preset impedance.

15. The wireless communication device of claim 11, wherein the antenna structure further comprises a middle frame, wherein the middle frame is made of metallic material and is parallel to the back board, the system ground plane further comprises the middle frame, the MHR is a metal sheet, the other end of the MHR is connected to the middle frame.

16. The wireless communication device of claim 12, wherein the side frame comprises an end portion, a first side portion, and a second side portion, the first side portion and the second side portion are respectively connected to both ends of the end portion, the slot is defined on a side of the back board near the end portion and extends in a direction of the first side portion and the second side portion;

wherein the side frame defines two gaps, the two gaps comprises a first gap and a second gap, the first gap and the second gap are spaced apart on the side frame;

wherein the side frame between the first gap and the second gap forms a first radiation portion, the side frame between the first gap and the slot located at an end of the second side portion forms a second radiation portion;

wherein the feed portion is electrically connected to the first radiation portion to feed a current to the first radiation portion and the second radiation portion; and wherein the first switch circuit is electrically connected to an end of the first radiation portion adjacent to the second gap, the second switch circuit is electrically connected to a middle location of the first radiation portion and is spaced from the feed portion.

17. The wireless communication device of claim 16, further comprising a first electronic component and a second electronic component, the first electronic component is positioned adjacent to an end of the first radiation portion near the first gap and is spaced apart from the first radiation portion through the slot, the feed portion and the second switch circuit are positioned at two sides of the first electronic component;

wherein the second electronic component is positioned adjacent to an end of the first radiation portion near the second gap and is spaced apart from the first radiation portion through the slot.

18. The wireless communication device of claim 16, wherein one end of the MHR is connected to the second side portion of the side frame, extends along a direction parallel to the second radiation portion, the MHR at least has a plane parallel to the second radiation portion; or the MHR is spaced apart from the second radiation portion and the first gap;

wherein the MHR comprises a first section, a second section, and a third section, the first section is substantially a straight section, the first section is perpendicularly connected to or perpendicularly spaced from the second side portion of the side frame;

wherein the second section is substantially arc-shaped, the second section is positioned parallel to the second radiation portion at a connecting portion of the second side portion and the end portion; and wherein the third section is substantially a straight section, the third section is positioned parallel to a part of the second radiation portion located at the end portion.

19. The wireless communication device of claim 18, wherein the third section of the MEM extends beyond the first gap; or the third section of the MHR extends to the first gap; or the third section of the MHR does not extend beyond the first gap.

20. The wireless communication device of claim 18, wherein when the feed portion supplies a current, the current flows through the first radiation portion, and toward to the second gap to excite a first working mode and generate a radiation signal in a first radiation frequency band;

wherein when the feed portion supplies a current, the current flows through the first radiation portion and the second radiation portion, the current further flows through the MEM along the side frame or the current is coupled to the MHR through the second radiation portion, the current flows through the MHR and finally flows to the system ground plane to excite a second working mode and generate a radiation signal in a second radiation frequency band;

wherein when the feed portion supplies a current, the current flows through the second radiation portion, the current further flows through the MHR along the side frame or the current is coupled to the MHR through the second radiation portion, the current flows through the MEM and finally flows to the system ground plane to excite a third working mode and generate a radiation signal in a third radiation frequency band;

wherein a frequency of a first radiation frequency band is less than a frequency of a second radiation frequency band, and a frequency of the second radiation frequency band is less than a frequency of the third radiation frequency band;

wherein the first working mode is a Long Term Evolution Advanced (LTE-A) low frequency mode, the second working mode is an LTE-A middle frequency mode, and the third working mode is an LTE-A high-frequency mode;

wherein the frequency of the first radiation frequency band is 700-960 MHz, the frequency of the second radiation frequency band is 1710-2170 MHz, and the frequency of the third radiation frequency band is 2300-2690 MHz.

* * * * *